US010676237B2

(12) United States Patent
Schuver

(10) Patent No.: US 10,676,237 B2
(45) Date of Patent: Jun. 9, 2020

(54) RESEALABLE BEVERAGE CAN LID

(71) Applicant: Steven S Schuver, St. Louis, MO (US)

(72) Inventor: Steven S Schuver, St. Louis, MO (US)

( * ) Notice: Subject to any disclaimer, the term of this patent is extended or adjusted under 35 U.S.C. 154(b) by 184 days.

(21) Appl. No.: 16/109,575

(22) Filed: Aug. 22, 2018

(65) Prior Publication Data

US 2019/0283927 A1 Sep. 19, 2019

Related U.S. Application Data

(63) Continuation-in-part of application No. 15/923,789, filed on Mar. 16, 2018, now Pat. No. 10,562,664, and a continuation-in-part of application No. 15/976,634, filed on May 10, 2018, now Pat. No. 10,562,665, and a continuation-in-part of application No. 15/990,333, filed on May 25, 2018, now Pat. No. 10,518,929.

(51) Int. Cl.

| | |
|---|---|
| ***B65D 17/40*** | (2006.01) |
| ***B65D 17/34*** | (2006.01) |
| ***B65D 17/28*** | (2006.01) |
| ***B65D 17/347*** | (2006.01) |

(52) U.S. Cl.

CPC ..... *B65D 17/4014* (2018.01); *B65D 17/347* (2018.01); *B65D 2517/0044* (2013.01); *B65D 2517/0046* (2013.01)

(58) Field of Classification Search

CPC ..... B65D 17/4014; B65D 17/4011; B65D 17/4012; B65D 17/404; B65D 17/401; B65D 17/28; B65D 51/20; B65D 51/28; B65D 51/222; B65D 51/18

USPC ..... 220/258.5, 258.4, 258.3, 258.1, 256.1, 220/730, 270, 272, 273, 276, 269, 268, 220/266, 265, 254.9, 254.3, 254.1, 259.1, 220/259.3, 259.4; 413/14, 12, 8

See application file for complete search history.

(56) References Cited

U.S. PATENT DOCUMENTS

| | | | | |
|---|---|---|---|---|
| 3,805,989 | A | 4/1974 | Walker | |
| 3,967,752 | A | 7/1976 | Cudzik | |
| 4,433,792 | A | 2/1984 | Mandel | |
| 4,887,712 | A | 12/1989 | Wells | |
| 5,351,853 | A | 10/1994 | Shock | |
| 5,452,818 | A | 9/1995 | Yost | |
| 8,336,726 | B2 * | 12/2012 | Ramsey | B65D 17/506 220/254.3 |
| 9,315,305 | B2 | 4/2016 | Robinson | |
| 2004/0256388 | A1 | 12/2004 | Rossetti et al. | |
| 2009/0032531 | A1 * | 2/2009 | Navare | B65D 17/4014 220/254.1 |
| 2013/0087563 | A1 | 4/2013 | Brandtner | |

* cited by examiner

*Primary Examiner* — Robert J Hicks
(74) *Attorney, Agent, or Firm* — David H. Chervitz

(57) ABSTRACT

A resealable beverage can has a lid having a top side having a first scored opening and a bottom side, a first rivet formed in the lid and extending outwardly from the top side of the lid, a tab portion connected to the first rivet, a second rivet formed in the lid and extending outwardly from the top side of the lid, the second rivet having an indentation formed in the bottom side of the lid, the second rivet having a second scored opening, a tack element connected to the indentation of the second rivet, and a closure element connected to the tack element.

20 Claims, 5 Drawing Sheets

RESEALABLE BEVERAGE CAN LID

CROSS REFERENCE TO RELATED APPLICATIONS

This application is a continuation-in-part of U.S. patent application Ser. No. 15/923,789 filed on Mar. 16, 2018, and is continuation-in-part of U.S. patent application Ser. No. 15/976,634 filed on May 10, 2018, and is a continuation-in-part of U.S. patent application Ser. No. 15/990,333 filed on May 25, 2018, the disclosures of which are incorporated herein by reference.

BACKGROUND

This disclosure relates generally to a beverage can lid having an opening, and more particularly to a resealable beverage can lid.

Beverage cans for containing liquids such as a carbonated beverages have become a universal and ubiquitous product. The beverage can is typically constructed of an aluminum alloy composition that may include aluminum, magnesium, manganese, silicon, and copper. The beverage can consists of a can body into which a liquid is filled and a can lid that is sealed to the can body. The can body may include a base or bottom that is dome shaped to resist internal pressure, a generally cylindrical section, a narrowed neck portion, and an open top edge. The can lid may include the lid portion that is about the same circumference as the narrowed neck portion of the can body, a scored opening or weakened portion, a tab portion that is used to open the scored opening portion, and a rivet that is used to secure the tab to the lid portion. The rivet is an integral piece of the lid portion and is formed by stretching the center of the lid portion upwardly and then drawn to form the rivet. The lid is sealed to the can body by trimming the open top edge of the can body, bending the trimmed edge, and seaming the bent trimmed edge to the lid. In this manner, any liquid contained within the can body is sealed. To open the beverage can the tab is lifted to press against the scored opening portion to partially push the scored opening portion into the can body to create an opening in the lid. The scored opening portion typically does not fully detach from the lid. Once opened, liquid from inside the can body may flow through the opening.

One problem associated with the use of the beverage can is that once opened it cannot be closed again. Since the liquid within the beverage can may be carbonated, after a period of time the carbonation escapes and the liquid becomes flat or stale. Once flat, the beverage can and its contents may be discarded which may be wasteful. Also, after opening the beverage can the contents may have to be consumed quickly because the contents cannot be preserved. Further, it is also possible that the contents of the beverage can may spill due to not being able to close the opening. In particular, when an individual is walking with an opened can the individual may trip or fall and the contents of the can may be spilled because the can is open. This may also be problematic if the beverage can is stationary and near electrical equipment such as a computer or a laptop and the can accidentally is knocked over. It is also possible that insects or other contaminants may infiltrate the beverage can through the opening. If this occurs then the beverage can and its contents should be thrown away.

The present disclosure is designed to obviate and overcome many of the disadvantages and shortcomings experienced with prior beverage can constructions. Particularly, it would be advantageous to be able to have a resealable beverage can lid for preserving the contents of the beverage can. Moreover, the present disclosure is related to a resealable beverage can lid that can be easily resealed for later use.

SUMMARY

In one form of the present disclosure, a resealable beverage can lid is disclosed which comprises a lid having a top side having a first scored opening and a bottom side, a first rivet formed in the lid and extending outwardly from the top side of the lid, a tab portion connected to the first rivet, a second rivet formed in the lid and extending outwardly from the top side of the lid, the second rivet having an indentation formed in the bottom side of the lid, the second rivet having a second scored opening, a tack element connected to the indentation of the second rivet, and a closure element connected to the tack element.

In another form of the present disclosure, a resealable beverage can lid comprises a lid having a top side having a first scored opening and a bottom side, a first rivet formed in the lid and extending outwardly from the top side of the lid, a first tab portion connected to the first rivet, a second rivet formed in the lid and extending outwardly from the top side of the lid, the second rivet having an indentation formed in the bottom side of the lid, the second rivet having a second scored opening, a second tab portion connected to the second rivet, a tack element connected to the indentation of the second rivet, and a closure element connected to the tack element.

In still another form of the present disclosure, a resealable beverage can lid is disclosed which comprises a lid having a top side having a first scored opening and a bottom side, a first rivet formed in the lid and extending outwardly from the top side of the lid, a tab portion connected to the first rivet, a second rivet formed in the lid and extending outwardly from the top side of the lid, the second rivet having an indentation formed in the bottom side of the lid, the second rivet having a second scored opening, a tack element connected to the indentation of the second rivet, a closure element connected to the tack element, and a guide track formed in the bottom side of the lid for guiding movement of the closure element.

In light of the foregoing comments, it will be recognized that the resealable beverage can lid of the present disclosure is of simple construction and design and which can be easily employed with highly reliable results.

The present disclosure provides a resealable beverage can lid that may be used to reseal an opened beverage can in order to preserve the contents of the beverage can for later use.

The present disclosure provides a resealable beverage can lid that employs an easy to use adjustment mechanism that allows an individual to reseal the lid of an opened beverage can.

The present disclosure provides a resealable beverage can lid that does not require any special tools to open or operate the resealable beverage can lid.

The present disclosure is also directed to a resealable beverage can lid that provides enhanced venting of any liquid in a beverage can to provide for a smoother flow of the liquid out of the beverage can.

The present disclosure also provides a resealable beverage can lid that can be used with any size beverage cans.

The present disclosure provides a resealable beverage can lid that can be constructed using readily available materials and construction techniques and machinery.

The present disclosure also provides a resealable beverage can lid having a closure mechanism that does not add significantly to the price of manufacturing the beverage can lid.

These and other advantages of the present disclosure will become apparent after considering the following detailed specification in conjunction with the accompanying drawings, wherein:

DETAILED DESCRIPTION OF A PREFERRED EMBODIMENT

Figure 1:
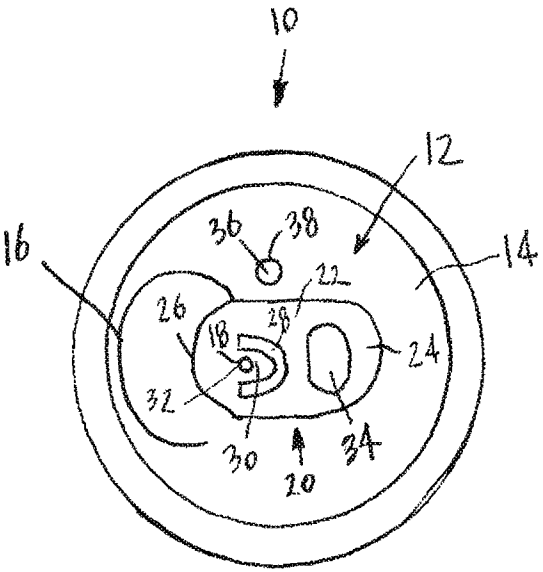
FIG. 1 is a top view of a resealable beverage can lid constructed according to the present disclosure.

Referring now to the drawings, wherein like numbers refer to like items, number 10 identifies a preferred embodiment of a resealable beverage can lid constructed according to the present disclosure. With reference now to FIG. 1, the resealable beverage can lid 10 is shown to comprise a lid 12 having a top side 14 having a first scored opening 16. The lid 12 has a first rivet 18 formed therein with the first rivet 18 extending outwardly from the top side 14 of the lid 12. The first rivet 18 is used to secure a tab portion 20 in place to the top side 14 of the lid. The tab portion 20 is used to open the first scored opening 16 to form an opening (not shown) in the lid 12. The tab portion 20 comprises a main body portion 22 having a rear lifting portion 24 and a forward rupturing portion 26. A generally U-shaped opening 28 is used to form a generally semicircular portion 30 that has an aperture 32 formed therein for receiving the first rivet 18. The first rivet 18 may be connected to the semicircular portion 30 at or through the aperture 32. An opening 34 is also formed in the rear lifting portion 24. A second rivet 36 extends upwardly from the top side 14 of the lid 12. A second scored opening 38 surrounds the second rivet 36. Unlike the first scored opening 16, the second scored opening 38 is formed to completely separate from the lid 12 once a rupturing force is applied to the second rivet 36. Once the second scored opening 38 is ruptured a rotational force may be applied to rotate the second rivet 36. The second rivet 36 is typically larger than the second scored opening 38 so that the second rivet 36 does not fall through the lid 12.

Figure 2:
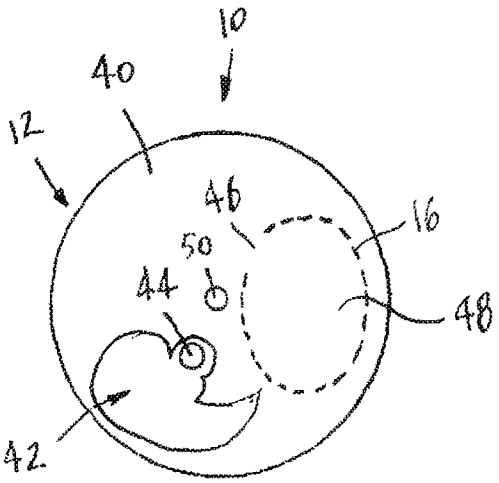
FIG. 2 is a bottom view of the resealable beverage can lid constructed according to the present disclosure.

FIG. 2 illustrates a bottom view of the resealable beverage can lid 12. The resealable beverage can lid 10 has a bottom side 40 of the lid 12 and a closure element 42 is held in place by a tack element 44. The scored opening 16 is shown in phantom in this particular view. The scored opening 16 also has a portion 46 that remains connected to the lid 12 so that when the scored opening 16 is ruptured a panel 48 remains attached to the lid 12. The closure element 42 is positioned in an initial or opened position against the bottom side 40 of the lid 12. The closure element 42 is capable of rotation by rotation of the second rivet 36 (FIG. 1) once the second rivet 36 has been freed from the lid 12 by rupturing the second scored opening 38 (FIG. 1). The scored opening 16 and the panel 48 are also shown in a closed position before the lid 12 is opened. The first rivet 18 (FIG. 1) has an indentation 50 formed in the bottom side 40 of the lid 12 during the manufacturing process that forms the first rivet 18. Although not shown in this particular view, the second rivet 36 is formed in the same manner as the first rivet 18 and an indentation, which is obscured by the closure element 42 and the tack element 44, is left over after the manufacturing process is completed.

Figure 3:
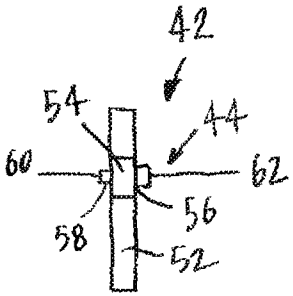
FIG. 3 is a cross-sectional side view of a closure element connected to a tack element constructed according to the present disclosure.

Referring now to FIG. 3, a cross-sectional side view of the closure element 42 having the tack element 44 inserted therein is shown. The closure element 42 has the main body portion 52, an extension portion 54, and the tack element 44 inserted through an aperture 56 formed in the extension portion 54. The tack element 44 has a shank portion 58 having an end 60 and a head portion 62 connected to the shank portion 58. The end 60 is connected to an indentation (not shown) that is left over in forming the second rivet 36. The shank portion 58 and the head portion 62 may be connected to the closure element 42 by welding, adhesive, or by forming the tack element 44 and the closure element 42 as a unitary construction. The head portion 62 may be larger than the aperture 56.

Figure 4:
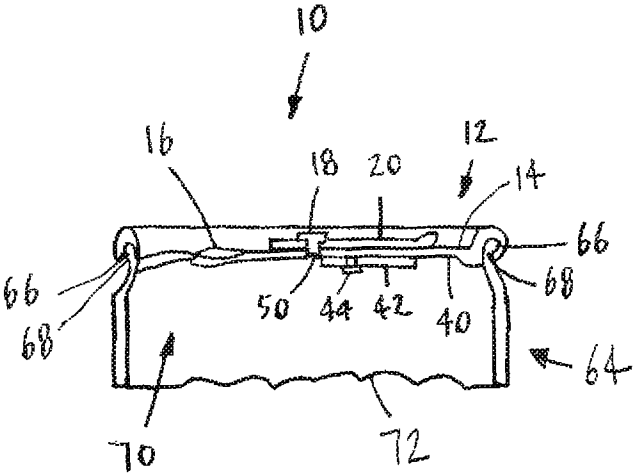
FIG. 4 is a partial cross-sectional view of a complete beverage can having a resealable beverage can lid constructed according to the present disclosure connected to a cylindrical can body with the complete beverage can being shown in a closed position and a closure element being shown in an opened position.

FIG. 4 shows a partial cross-sectional view of the resealable beverage can lid 10 connected to a cylindrical can body 64. The resealable beverage can lid 10 is shown to comprise the lid 12 having the top side 14 having the scored opening 16 and the bottom side 40. The lid 12 has the first rivet 18 formed therein with the first rivet 18 extending outwardly from the top side 14 of the lid 12. The first rivet 18 has an indentation 50 formed in the bottom side 40 of the lid 12 during the manufacturing process that forms the first rivet 18. The tab portion 20 is connected to the first rivet 18. As can be appreciated, the tab portion 20 is operated to open the scored opening 16. The lid 12 has a flange 66 that is shaped to receive a neck portion 68 of the cylindrical can body 64. The can body 64 has an interior 70 in which a liquid 72, such as a carbonated beverage, may be filed. As can be appreciated, the lid 12 is used to seal or cap the neck portion 68 of the can body 64. The closure element 42 is initially positioned to be away from the scored opening 16 so as not to interfere with the operation of the scored opening 16. The closure element 42 is shown being connected to the bottom side 40 by use of the tack element 44. The second rivet 36 is obscured in this particular view by the tab portion 20.

Figure 5:
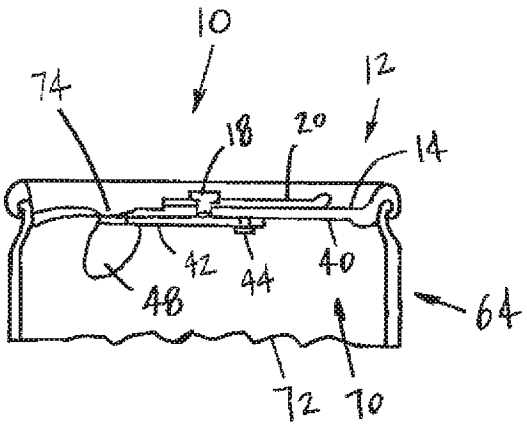
FIG. 5 is a partial cross-sectional view of a complete beverage can having a resealable beverage can lid constructed according to the present disclosure connected to a cylindrical can body with the complete beverage can being shown in an opened position and a closure element being shown in a closed position.

Referring now to FIG. 5, another partial cross-sectional view of the resealable beverage can lid 10 connected to a cylindrical can body 64 is depicted. The scored opening 16 has been ruptured by use of the tab portion 20 to create an opening 74 in the lid 12. The panel 48 has been pushed or positioned into the interior 70 of the can body 64. The closure element 42 of the resealable beverage can lid 10 has been rotated into a closed position to cover or reseal the opening 74. In this condition the contents or the liquid 72 within the can body 64 is not able to escape through the opening 74 because the closure element 42 is blocking the opening 74. In order to reopen the opening 74 the closure element 42 is rotated to an opened position and once again the contents or the liquid 72 within the can body 64 may be removed or emptied. The tab portion 20 obscures the second rivet 36 in this view. However, as has been discussed above, once the second scored opening 38 has been ruptured the second rivet 36 is capable of rotating the closure member 42 into an opened position or a closed position. The top side 14 and the bottom side 40 of the lid 12 are also shown. Also, the second rivet 36 is obscured in this particular view by the tab portion 20.

The operation of the resealable beverage can lid 10 may be as follows. The can body 64 is filled with the liquid 72 and the lid 12 is sealed to the can body 64 by use of the flange 66 and the neck portion 68. The completed product is then made available for purchase by an individual or consumer. Once purchased and the individual wants to use the product the individual will lift the rear lifting portion 24 of the tab portion 20 which causes the forward rupturing portion 26 to press against the scored opening 16 to move the scored opening 16 into the interior 70 of the can body 64 to create the opening 74. Once the lid 12 has been opened the rear lifting portion 24 of the tab portion 20 is released which causes the tab portion 20 to return to an initial position. The opening 74 allows the individual to drink the liquid 72 from the can body 64. When the individual wants to close the opening 74 the individual may use the second rivet 36 to rupture the second scored opening 38 to free the second scored opening 38 from the lid 12. The second rivet 36 is also free to rotate. As can be appreciated, rotation of the second rivet 36 causes the closure element 42 to move into the closed position to cover the opening 74. The can body 64 may be held, stored, or refrigerated without fear of the liquid 72 spilling out of the can body 64 or the liquid 72 becoming stale. When the individual desires to again drink from the can body 64 the individual rotates the second rivet 36 to move the closure element 42 into the opened position uncovering the opening 74. As is known, once the liquid 72 from the can body 64 has been consumed, the can body 64 and the lid 12 may be recycled.

Figure 6:
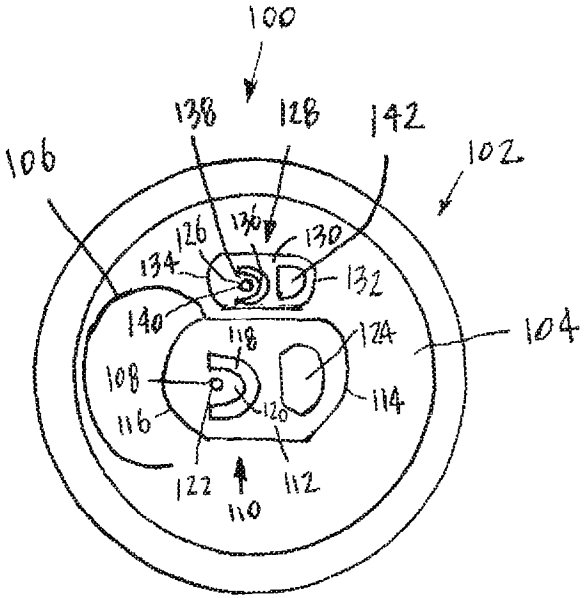
FIG. 6 is a top view of another preferred embodiment of a resealable beverage can lid constructed according to the present disclosure.

FIG. 6 shows another embodiment of a resealable beverage can lid 100 constructed according to the present disclosure. The resealable beverage can lid 100 comprises a lid 102 having a top side 104 having a first scored opening 106. The lid 102 has a first rivet 108 formed therein with the first rivet 108 extending outwardly from the top side 104 of the lid 102. The first rivet 108 is used to secure a first tab portion 110 in place to the top side 104 of the lid 102. The first tab portion 110 is used to open the first scored opening 106 to form an opening (not shown) in the lid 102. The tab portion 110 comprises a main body portion 112 having a rear lifting portion 114 and a forward rupturing portion 116. A generally U-shaped opening 118 is used to form a generally semicircular portion 120 that has an aperture 122 formed therein for receiving the first rivet 108. The first rivet 108 may be connected to the semicircular portion 120 at or through the aperture 122. An opening 124 is also formed in the rear lifting portion 114. A second rivet 126 extends upwardly from the top side 104 of the lid 102. The second rivet 126 is used to secure a second tab portion 128 in place to the top side 104 of the lid 102. The second tab portion 128 may have a main body portion 130 having a rear lifting portion 132 and a forward edge 134. A generally U-shaped opening 136 is used to form a generally semicircular portion 138 that has an aperture 140 formed therein for receiving the second rivet 126. The second rivet 126 may be connected to the semicircular portion 138 at or through the aperture 140. An opening 142 may also be formed in the rear lifting portion 132. Although not shown, a second scored opening may be formed around the second rivet 126. The second tab portion 128 is used to apply a rupturing force to separate the second scored opening from the lid 102.

Figure 7:
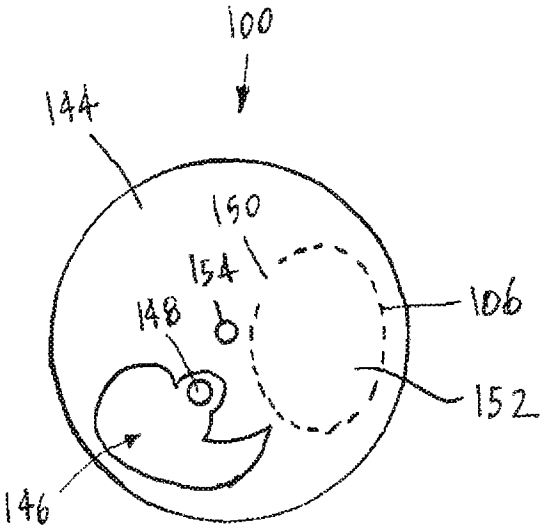
FIG. 7 is a bottom view of the resealable beverage can lid shown in FIG. 6.

Referring now to FIG. 7, a bottom view of the resealable beverage can lid 100 is illustrated. The resealable beverage can lid 100 has a bottom side 144 of the lid 102 and a closure element 146 is held in place by a tack element 148. The first scored opening 106 is shown in phantom in this particular view. The first scored opening 106 also has a portion 150 that remains connected to the lid 102 so that when the first scored opening 106 is ruptured a panel 152 remains attached to the lid 102. The closure element 146 is positioned in an initial or opened position against the bottom side 144 of the lid 102. The closure element 146 is capable of rotation by rotation of the second tab portion 128 (FIG. 6) once the second rivet 126 has been freed from the lid 102 by rupturing a second scored opening (not shown) that surrounds the second rivet 126. In essence, once the second scored opening is freed from the lid 102 rotation of the second tab portion 128 and hence the second rivet 126 and any material (not shown) surrounding the second rivet 126 will cause rotation of the closure element 146 due to the tack element 148 being connected to the material surrounding the second rivet 126. The first scored opening 106 and the panel 152 are also shown in a closed position before the lid 102 is opened. The first rivet 108 (FIG. 6) has an indentation 154 formed in the bottom side 144 of the lid 102 during the manufacturing process that forms the first rivet 108. Although not shown in this particular view, the second rivet 126 is formed in the same manner as the first rivet 108 and an indentation, which is obscured by the closure element 146 and the tack element 148, is left over after the manufacturing process is completed.

Figure 8:
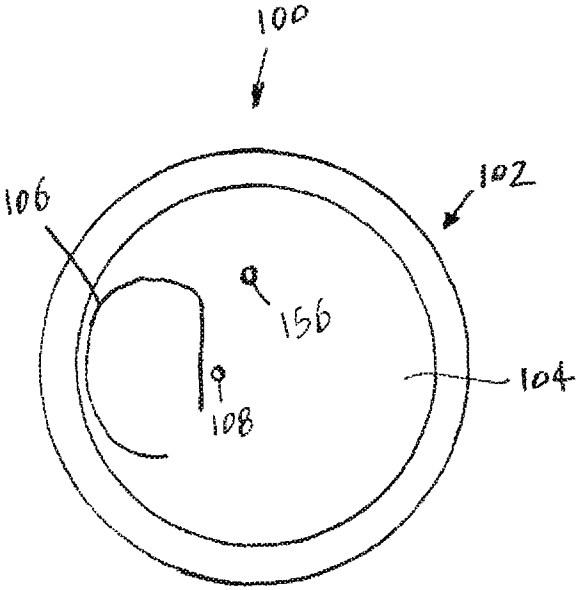
FIG. 8 is a top view of the resealable beverage can lid shown in FIG. 6 with a tab portion removed and a second rivet removed for clarity.

With particular reference now to FIG. 8, a top view of the resealable beverage can lid 100 is shown with the first tab portion 110 being removed and the second rivet 126 and the second tab portion 128 being removed for purposes of clarity. As should be appreciated, this will be a similar view of the resealable beverage can lid 10 with the tab portion 20 being removed and the second rivet 36 being removed. The resealable beverage can lid 100 has the lid 102, the top side 104, the first scored opening 106, and the first rivet 108. A second scored opening 156 is formed in the area in which the second rivet 126 would be. In essence, the second scored opening 156 surrounds the second rivet 126. Applying a force to the second rivet 126 by use of the second tab portion 128 will rupture and free the second scored opening 156 from the top side 104 of the lid 102. However, the second rivet 126 and the second tab portion 128 will be held in place to the lid 102 due to the closure element 146 (FIG. 7) being connected to the second rivet 126 (FIG. 6). Although not shown, the second scored opening 156 may be formed in a similar manner as the first scored opening 106. In particular, a knife may be used to carve away material from the top side 104 of the lid 102 or the bottom side 144 of the lid 102 to form the second scored opening 156.

The operation of the resealable beverage can lid 100 may be as follows. The first tab portion 110 will be lifted by use of the rear lifting portion 114 which causes the forward rupturing portion 116 to press against the scored opening 106 to move the scored opening 106. Once the lid 102 has been opened the rear lifting portion 114 of the first tab portion 110 is released which causes the first tab portion 110 to return to an initial position. To use the closure element 146, the second tab portion 128 is lifted by use of the rear lifting portion 132 which causes the forward edge 134 to bind against the top side 104 of the lid which assists in rupturing the second scored opening 156. The second tap portion 128 may now be freely rotated to cause rotation of the closure element 146 into a closed position covering the lid 102. When the lid 102 needs to be uncovered, the second tab portion 128 may be rotated to rotate the closure element 146 into an opened position.

Figure 9:
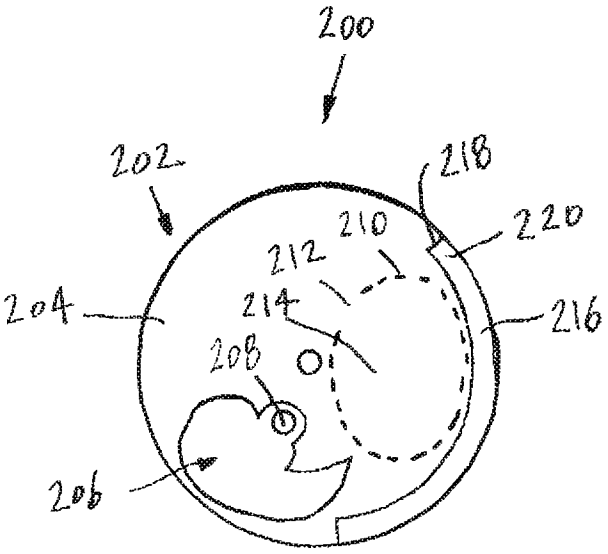
FIG. 9 is a bottom view of another preferred embodiment of a resealable beverage can lid constructed according to the present disclosure.

FIG. 9 illustrates a bottom view of another preferred embodiment of a resealable beverage can lid 200. The resealable beverage can lid 200 has a lid 202 having a bottom side 204 having a closure element 206 connected to a tack element 208. A scored opening 210 is shown in phantom in this particular view. The scored opening 210 also has a portion 212 that remains connected to the lid 202 when the scored opening 210 has been opened. A panel 214 is formed when the scored opening 210 is opened, as should be realized from the above discussions. The bottom side 204 also has a guide track 216 formed in the bottom side 204 of the lid 202 for guiding movement of the closure element 206. The guide track 216 may be in the form of a raised rib and the lid 202 may be manufactured to include the guide track 216. The guide track 216 may also have a stop 218 at an end 220 of the guide track 216. The stop 218 may be used to prevent the closure element 206 from moving past a certain point which might damage the closure element 206. The closure element 206 is positioned in an initial or opened position against the bottom side 204 of the lid 202. Although not shown in this particular view, the resealable beverage can lid 200 may also have a top side of the lid 202 similar in construction and operation as the resealable beverage can lid 10 or 100. The closure element 206 is capable of being rotated into a closed position and back into the opened position by movement of the various components associated with the resealable beverage can lid 10 or 100, as has been previously described.

Preferably, the resealable beverage can lids 10, 100, and 200 will be constructed of a relatively lightweight material so that it can be easily used and manufactured. By way of example only, the resealable beverage can lids 10, 100, and 200 may be constructed of aluminum or an aluminum alloy.

Although it has been indicated herein that the resealable beverage can lids 10, 100, and 200 are used with cans that contain a liquid, such as a carbonated beverage, it is also possible and contemplated that the cans may contain other items such as powders, spices, foods, syrups, gums, candies, or any other item that can be removed from an opening in the lids 10, 100, and 200.

It should also be noted that when the first scored opening 16 and the second scored opening 38 of the lid 12 have been ruptured, the interior 70 of the circular can body 64 is better vented to allow the liquid 72 to more smoothly flow out of the opening 74 formed in the lid 12. Also, this improved venting is found in the lid 102 when the first scored opening 106 and the second scored opening 156 are both ruptured.

From all that has been said, it will be clear that there has thus been shown and described herein a resealable beverage can lid which fulfills the various objects and advantages sought therefor. It will be apparent to those skilled in the art, however, that many changes, modifications, variations, and other uses and applications of the subject resealable beverage can lid are possible and contemplated. All changes, modifications, variations, and other uses and applications which do not depart from the spirit and scope of the disclosure are deemed to be covered by the disclosure, which is limited only by the claims which follow.

What is claimed is:

1. A resealable beverage can lid comprising:
- a lid having a top side having a first scored opening and a bottom side;
- a first rivet formed in the lid and extending outwardly from the top side of the lid;
- a tab portion connected to the first rivet;
- a second rivet formed in the lid and extending outwardly from the top side of the lid, the second rivet having an indentation formed in the bottom side of the lid, the second rivet having a second scored opening;
- a tack element connected to the indentation of the second rivet; and
- a closure element connected to the tack element.

2. The resealable beverage can lid of claim 1 wherein the closure element comprises a main body portion having an extension portion having an aperture for receiving the tack element.

3. The resealable beverage can lid of claim 2 wherein the main body portion comprises a generally oval shape that is capable of covering an opening formed in the lid by rupturing the scored opening.

4. The resealable beverage can lid of claim 1 wherein the closure element may be positioned at a first position and may be moved to a second position.

5. The resealable beverage can lid of claim 1 wherein the second rivet is positioned on the top side of the lid.

6. The resealable beverage can lid of claim 1 wherein the closure element is initially positioned in an opened position and may be rotated to a closed position to cover an opening formed in the lid by rupturing the first scored opening.

7. The resealable beverage can lid of claim 1 wherein the second rivet comprises a head portion with the head portion being larger than the second scored opening.

8. A resealable beverage can lid comprising:
- a lid having a top side having a first scored opening and a bottom side;
- a first rivet formed in the lid and extending outwardly from the top side of the lid;
- a first tab portion connected to the first rivet;
- a second rivet formed in the lid and extending outwardly from the top side of the lid, the second rivet having an indentation formed in the bottom side of the lid, the second rivet having a second scored opening;
- a second tab portion connected to the second rivet;
- a tack element connected to the indentation of the second rivet; and
- a closure element connected to the tack element.

9. The resealable beverage can lid of claim 8 wherein the closure element comprises a main body portion having an extension portion having an aperture for receiving the tack element.

10. The resealable beverage can lid of claim 9 wherein the main body portion comprises a generally oval shape that is capable of covering an opening formed in the lid by rupturing the first scored opening.

11. The resealable beverage can lid of claim 8 wherein the tack element comprises a shank portion having an end and a head portion connected to the shank portion with the end connected to the indentation and the closure element comprises a main body portion having an extension portion having an aperture for receiving the shank portion of the tack element there through for allowing the closure element to rotate about the shank portion.

12. The resealable beverage can lid of claim 8 wherein the closure element may be positioned at a first position and may be moved to a second position.

13. The resealable beverage can lid of claim 8 wherein the closure element is initially positioned in an opened position and may be rotated to a closed position to cover the opening formed in the lid by rupturing the first scored opening.

14. The resealable beverage can lid of claim 8 wherein the second rivet is positioned on the top side of the lid.

15. The resealable beverage can lid of claim 8 wherein the tack element comprises a shank portion having an end and a head portion connected to the shank portion with the end connected to the indentation.

16. A resealable beverage can lid comprising:

a lid having a top side having a first scored opening and a bottom side;

a first rivet formed in the lid and extending outwardly from the top side of the lid;

a tab portion connected to the first rivet;

a second rivet formed in the lid and extending outwardly from the top side of the lid, the second rivet having an indentation formed in the bottom side of the lid, the second rivet having a second scored opening;

a tack element connected to the indentation of the second rivet;

a closure element connected to the tack element; and a guide track formed in the bottom side of the lid for guiding movement of the closure element.

17. The resealable beverage can lid of claim 16 wherein the guide track further comprises an end having a stop.

18. The resealable beverage can lid of claim 16 wherein the closure element comprises a main body portion having a generally oval shape that is capable of covering an opening formed in the lid by rupturing the first scored opening.

19. The resealable beverage can lid of claim 16 wherein the closure element comprises a main body portion having an extension portion having an aperture for receiving the tack element.

20. The resealable beverage can lid of claim 16 wherein the closure element is initially positioned in an opened position and may be rotated to a closed position to cover an opening formed in the lid by rupturing the first scored opening.

* * * * *